US007017879B2

(12) United States Patent
Wetterberg et al.

(10) Patent No.: US 7,017,879 B2
(45) Date of Patent: Mar. 28, 2006

(54) BRACKET FOR OPEN BOTTOM TYPE CABINET

(75) Inventors: Brandon Robert Wetterberg, Des Moines, IA (US); Michael Joseph Stock, Ames, IA (US)

(73) Assignee: Hirsh Industries, Inc., Urbandale, IA (US)

( * ) Notice: Subject to any disclaimer, the term of this patent is extended or adjusted under 35 U.S.C. 154(b) by 0 days.

(21) Appl. No.: 10/704,857

(22) Filed: Nov. 10, 2003

(65) Prior Publication Data

US 2005/0098694 A1 May 12, 2005

(51) Int. Cl.
*A47B 91/00* (2006.01)

(52) U.S. Cl. ..... 248/346.11; 16/29; 16/30

(58) Field of Classification Search ..... 248/346.11, 248/129; 16/29, 30, 31 R
See application file for complete search history.

(56) References Cited

U.S. PATENT DOCUMENTS

| | | | | |
|---|---|---|---|---|
| 3,975,071 | A | 8/1976 | Quinn | |
| 3,988,800 | A | 11/1976 | Sachser | |
| 4,068,342 | A | 1/1978 | Carrier | |
| 4,090,756 | A | 5/1978 | Frey et al. | |
| 4,187,578 | A * | 2/1980 | Little | 16/29 |
| 4,339,842 | A | 7/1982 | Fontana et al. | |
| 4,459,920 | A * | 7/1984 | Cwik | 108/107 |
| 4,485,997 | A | 12/1984 | Potter | |
| 4,700,430 | A | 10/1987 | Raftery | |
| 4,719,663 | A | 1/1988 | Termini | |
| 4,720,893 | A | 1/1988 | Mellwig et al. | |
| 5,136,751 | A * | 8/1992 | Coyne et al. | 16/29 |
| 5,524,322 | A | 6/1996 | Muehlen | |
| 5,549,376 | A | 8/1996 | Domenig | |
| 5,802,668 | A | 9/1998 | Gosselin | |
| 5,810,459 | A | 9/1998 | Barrett et al. | |
| 5,971,408 | A | 10/1999 | Mandel et al. | |
| 5,980,008 | A | 11/1999 | Stoever | |
| 6,550,100 | B1 | 4/2003 | Drucker et al. | |
| D479,117 | S | 9/2003 | Mercier | |
| 6,725,501 | B1 * | 4/2004 | Harris et al. | 16/35 R |
| 2001/0042286 | A1 * | 11/2001 | Henriott et al. | 16/29 |
| 2003/0071547 | A1 | 4/2003 | Domenig | |
| 2004/0251649 | A1 * | 12/2004 | Wu | 280/86.1 |

* cited by examiner

*Primary Examiner*—Ramon O Ramirez
(74) *Attorney, Agent, or Firm*—Ryndak & Suri LLP

(57) ABSTRACT

A bracket is disclosed for use in open bottom type cabinets, such as file cabinets, which enables caster assemblies and the like to be secured thereto. The bracket is configured to be secured in the corners of an open bottom cabinet. In accordance with the present invention, the bracket provides stiffening of the cabinet as well as a secure surface for securing caster assemblies thereto. The brackets are simply mounted to the corners of the cabinet utilizing, for example, a pair of fasteners.

10 Claims, 6 Drawing Sheets

BRACKET FOR OPEN BOTTOM TYPE CABINET

BACKGROUND OF THE INVENTION

1. Field of the Invention

The present invention relates to a bracket for a cabinet and more particularly to a bracket configured to be secured to the corners of an open bottom type cabinet which enables caster assemblies and the like to be secured thereto.

2. Description of the Prior Art

Various cabinets and other devices are known that are formed with an open bottom. For example, an open bottom file cabinet is shown in FIG. 1, identified with the reference numeral 20. Such file cabinets 20 are known to be formed from a relatively light gage carbon steel i.e. (0.030 inches=steel gage 22) and include a pair of spaced apart side panels 22 and 24 and a rear panel 26. The front of such file cabinets 20 includes a number of drawers, generally identified with the reference numeral 28. As shown, an L-shaped channel 30 is provided on the front of the cabinet 20 to interconnect the side panels 22 and 24. The L-shaped channel 30 includes a lip 32. The side panels 22 and 24, as well as the rear panel 26, are also formed with lips 34, 36 and 38. The lips 32, 34, 36 and 38 form support surfaces for supporting the cabinet 20 in an upright position.

In certain applications, it is desired to add additional functionality. For example, in some applications, it is desired to facilitate movement of such file cabinets 20. For example, U.S. Pat. No. 4,485,997 discloses a rotatable base unit for a file cabinet. The rotatable base unit disclosed in the '997 patent is a separate rotating support that is used to support a file cabinet and allow the file cabinet to rotate in position. The rotatable base unit includes a fixed floor support and a rotating disk. Unfortunately, the rotatable base unit does not allow movement of the file cabinet in other than a rotating position. Another problem associated with such rotatable base units is that it is relatively expensive.

In order to solve this problem, U.S. Pat. No. 5,980,008 discloses a caster base adapted to be secured to the bottom of a cabinet and form a support for casters. The caster base is formed as a generally rectangular support from a pair of spaced apart support plates, connected together by a pair of struts and integrated into the cabinet bottom. Although the caster base disclosed in the '008 patent provides a relatively secure method for adding casters to a file cabinet, the caster base is relatively expensive and thus may not be commercially viable for some file cabinets, particularly, low-end file cabinets made from relatively light gauge steel, generally available at discount retailers.

U.S. Pat. No. 5,524,322 discloses another type of system for providing casters on a generally open bottom type cabinet, such as a file cabinet. In particular, the '322 patent includes a pair of elongated brackets, formed with a length equal to the width of the cabinet. The brackets are secured to the bottom of the cabinet and secured to the sidewalls. The elongated brackets are used to support a caster mounting bracket. Unfortunately, the brackets disclosed in the '322 patent are relatively expensive and would be relatively difficult to install.

U.S. Pat. No. 4,719,663 discloses a cabinet support bracket for a cabinet. Unfortunately, the bracket disclosed in the '663 patent is only suitable for solid bottom cabinets and is not suitable for open bottom type cabinets, for example, as illustrated in FIG. 1.

Thus, there is a need for a relatively simple and low cost system for attaching casters and the like to open bottom cabinets, such as file cabinets.

SUMMARY OF THE PRESENT INVENTION

The present invention relates to a bracket for use in open bottom type cabinets, such as file cabinets. The bracket in accordance with the present invention enables caster assemblies and the like to be secured thereto and is configured to be secured in the corners of an open bottom cabinet. In particular, the bracket is secured to the support lips formed on the bottom of an open bottom type cabinet. In accordance with the present invention, the bracket provides stiffening of the cabinet as well as a secure surface for securing caster assemblies and the like thereto.

DESCRIPTION OF THE DRAWING

These and other advantages of the present invention will be readily understood with reference to the following specification and attached drawing wherein.

DETAILED DESCRIPTION

Figure 1:
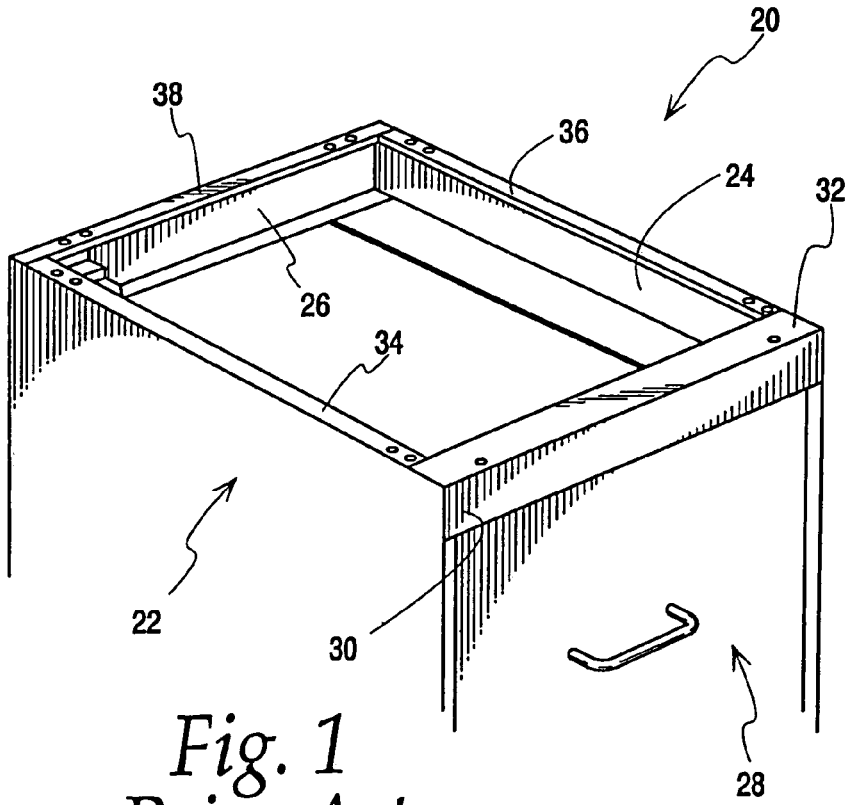
Fig. 1 Prior Art
FIG. 1 is a partial perspective view of an open bottom type cabinet for use with the present invention, shown upside down.
Figure 2:
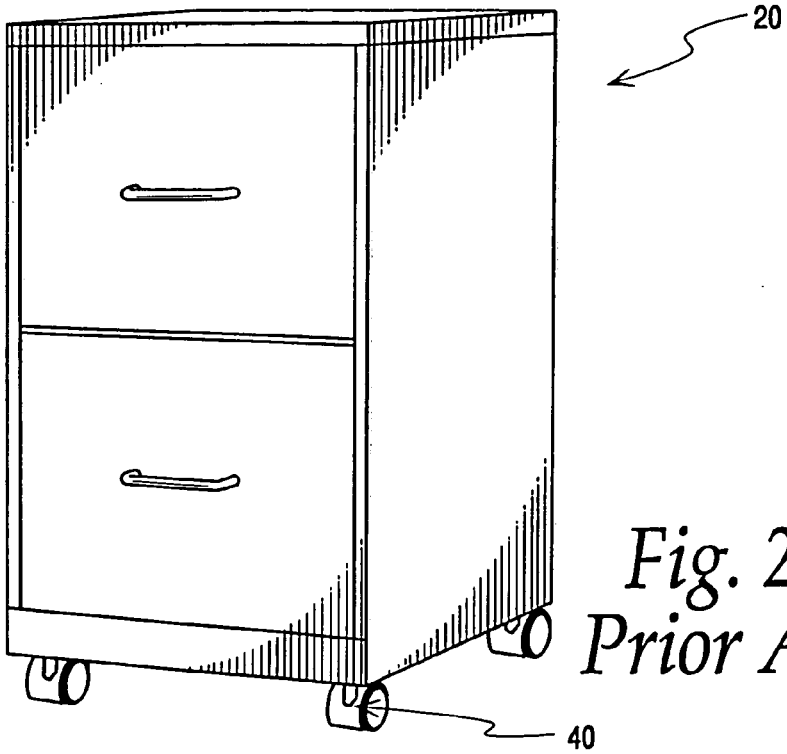
Fig. 2 Prior Art
FIG. 2 is a perspective view of the cabinet illustrated in FIG. 1 being supported by casters.

The present invention relates to a bracket for use with open bottom type cabinets, for example, the open bottom type file cabinet 20, illustrated in FIG. 1 which enables caster assemblies, table legs and the like, generally identified with the reference numeral 40, to be secured thereto. The bracket eliminates the need for a cabinet support base or brackets which span the width of the cabinet as disclosed in the prior art to support caster assemblies. Accordingly, the bracket in accordance with the present invention is relatively inexpensive and thus is commercially viable with low end type file cabinets, such as file cabinets sold at discount retailers. In addition, the bracket in accordance with the present invention is simple enough to install to allow consumers to quickly and easily install the brackets and caster assemblies or other devices as described below to the bottom of the cabinet. As such, the cabinets can be shipped with the caster or other devices and brackets uninstalled to enable these devices to be installed by the end users, if desired. Alternatively, the bracket or other devices can be supplied as an aftermarket item, which would additionally require the consumer to drill the mounting holes. As will be discussed in more detail below, each bracket can be secured to the cabinet with a few standard fasteners. Once the brackets are installed, the caster assemblies or other devices can be secured thereto simply and easily with one or more additional fasteners.

Figure 11:
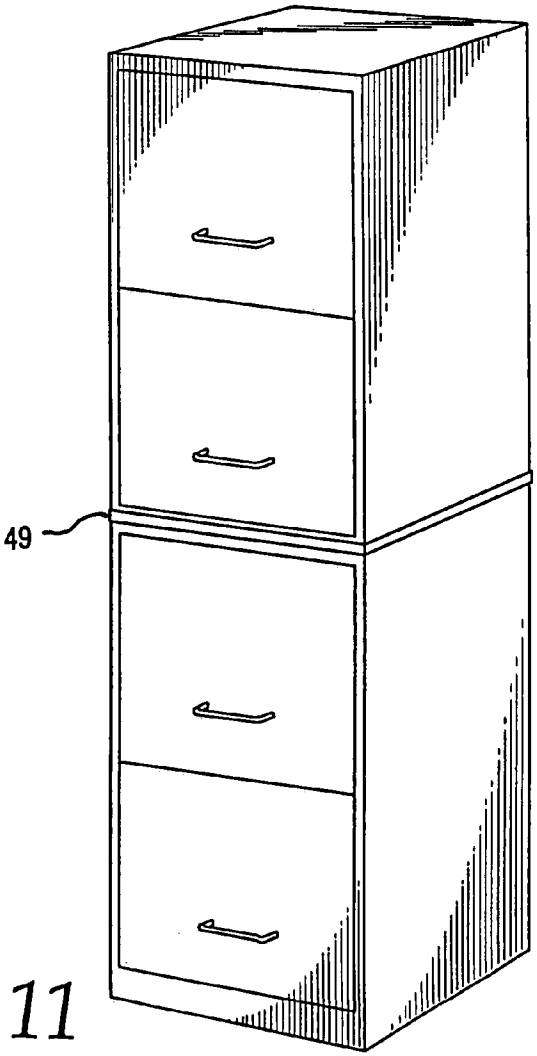
FIG. 11 is a perspective view of another alternate embodiment of the invention showing the bracket in accordance with the present invention being used to support another bracket used for stacking multiple open bottom cabinets.
Figure 10:
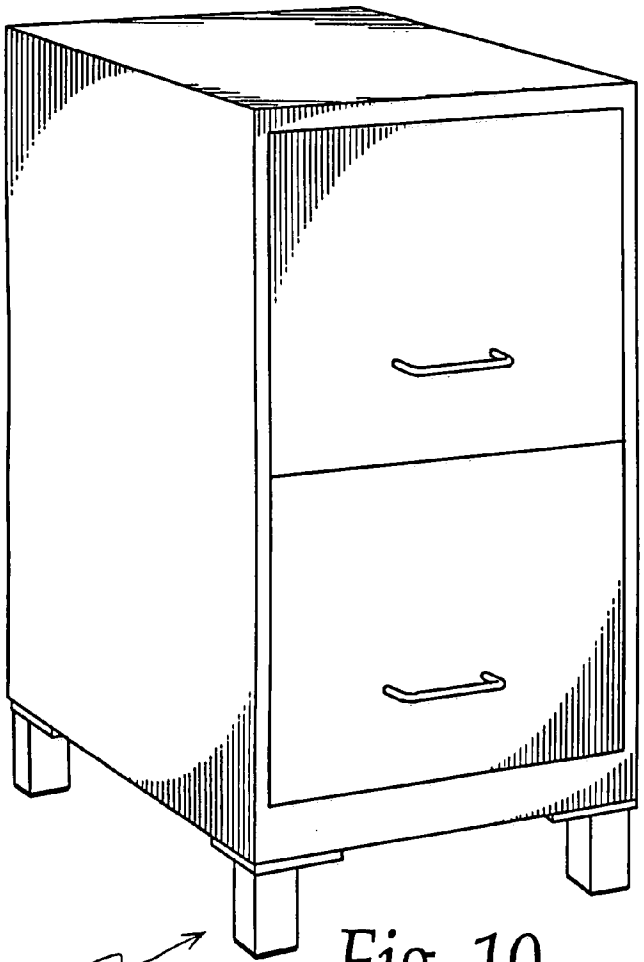
FIG. 10 is an alternate embodiment of the invention showing the bracket in accordance with the present invention being used to support cabinet legs.
Figure 13:
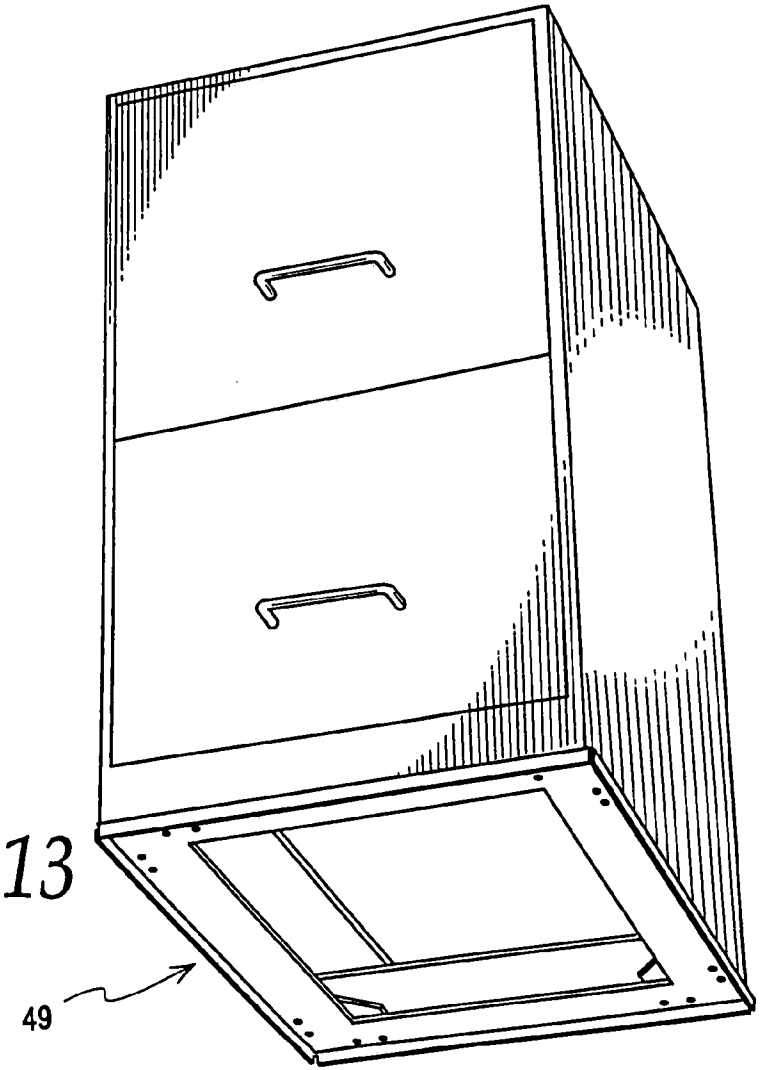
FIG. 13 is a perspective view showing the bracket illustrated in FIG. 12, assembled to the bottom of a cabinet.
Figure 12:
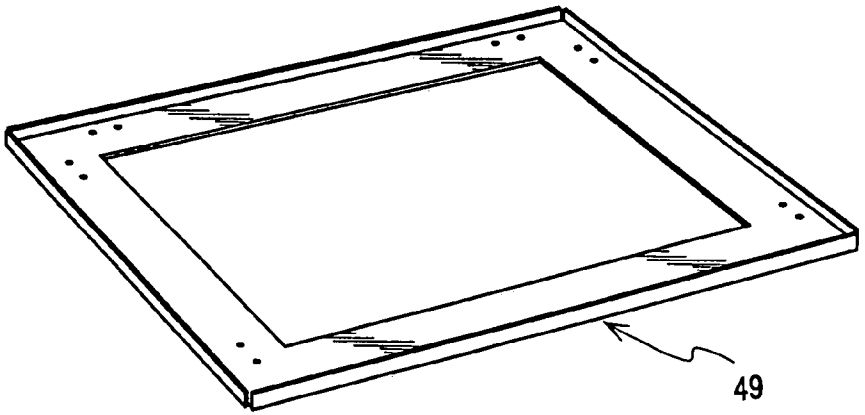
FIG. 12 is a perspective view of a bracket used for stacking the cabinets as illustrated in FIG. 11.

Although the bracket is described in detail as a support for caster assemblies 40, it is also suitable for use as a support for other devices as well. In particular, the bracket 52 (FIG. 4) in accordance with the present invention may also be used with open bottom type cabinets to support leg assemblies 51 (FIG. 10) and to enable cabinets 20 to be stacked on top of each other as shown in FIG. 11 with another bracket 49 (FIGS. 12 and 13) that allows cabinets to be stacked. Indeed, the bracket 52 (FIG. 4) can be used to support virtually any type of device that gets attached to a cabinet.

Figure 3:
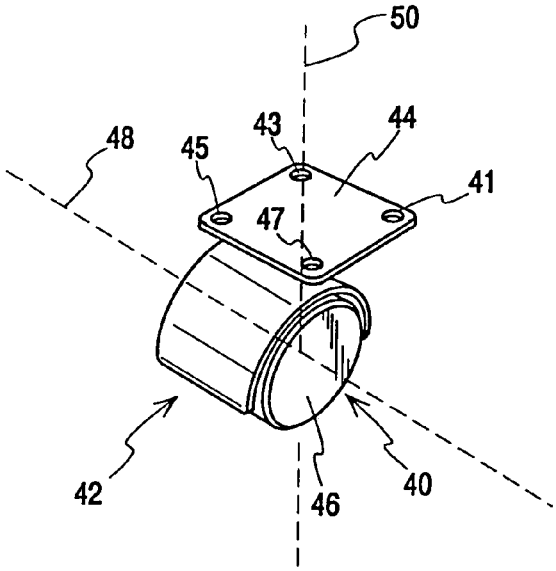
FIG. 3 is a perspective view of an exemplary caster assembly for use with the present invention.
Figure 9:
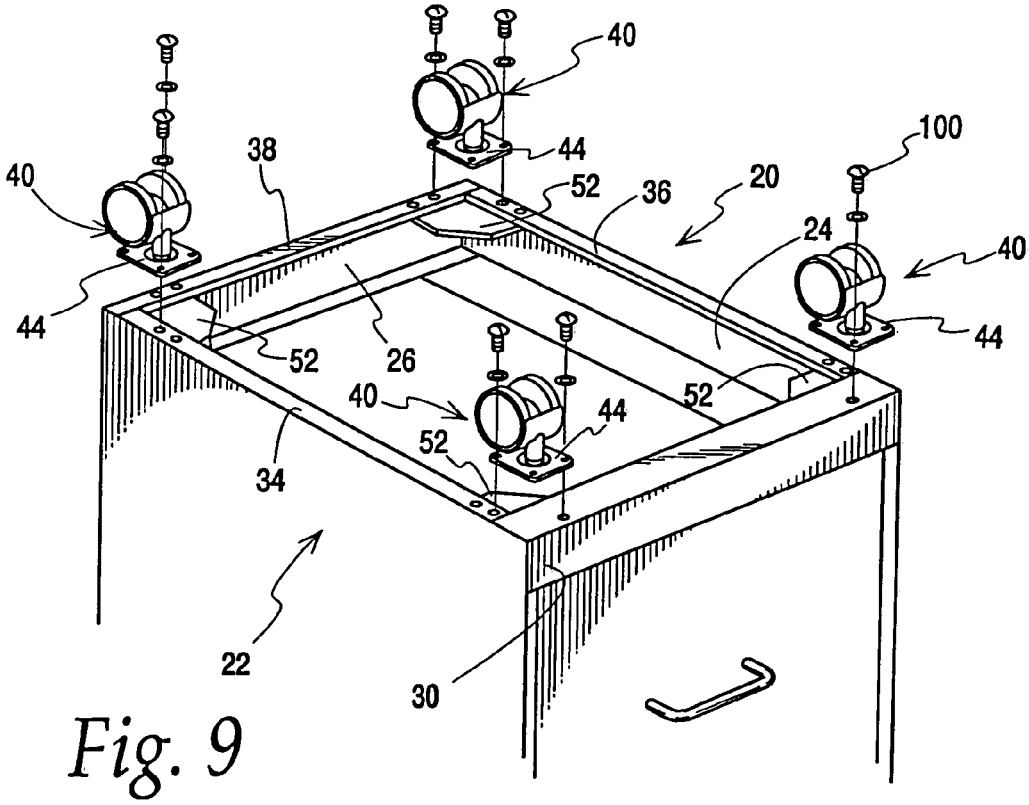
FIG. 9. illustrates the securement of the castor assembly to the cabinet and bracket in accordance with the present invention.

In addition, various types of caster assemblies 40 are suitable for use with the present invention. An exemplary caster assembly 40 is illustrated in FIGS. 3 and 9. As shown, the caster assembly 40 includes a caster portion 42 carried by a generally rectangular plate 44, referred to herein as a "caster support plate." The caster portion 42 includes a wheel 46 that is rotatable relative to the caster support plate 44. As shown, the wheel 46 is rotatable about a horizontal axis 48. However, the caster assemblies 40 may also be rotatable about a vertical axis 50. It is also contemplated that both types of caster assemblies (i.e., rotatable about a horizontal axis 48 and a vertical axis 50) may be used on the same cabinet 20.

In accordance with an important aspect of the invention, a bracket 52 is provided to enable caster assemblies 40 to be installed on open bottom type cabinets 20. The bracket 52 provides a dual function. First, the bracket 52 serves to stiffen the open bottom of the cabinet 20. Secondly, the bracket 52 enables the caster assemblies 40 to be secured thereto, relatively easily.

Figure 4:
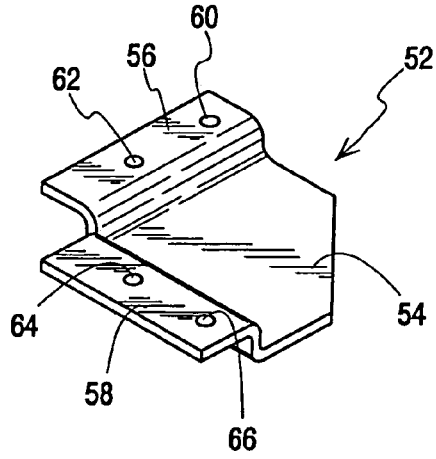
FIG. 4 is a perspective view of an exemplary bracket in accordance with the present invention.
Figure 7:
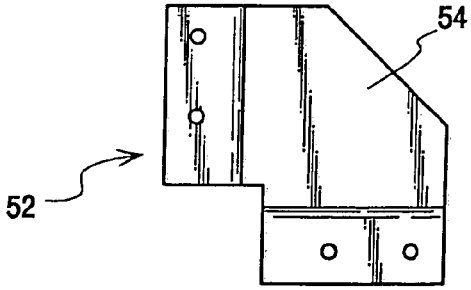
FIG. 7 is an plan view of the exemplary bracket illustrated in FIG. 4, shown with exemplary dimensions.
Figure 6:
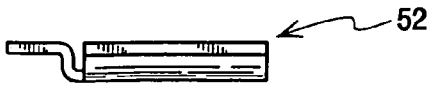
FIG. 6 is an elevational view of the exemplary bracket illustrated in FIG. 4, shown with exemplary dimensions.

As shown in FIGS. 4, 6, and 7, the bracket 52 is formed as a corner bracket and includes a gusset plate 54 defining at least two sides and a corner and a pair of raised flanges 56 and 58. Each of the raised flanges 56 and 58 includes a pair of spaced apart apertures 60 and 62; 64 and 66; and each of the flanges 56 and 58 is adapted to be aligned with corresponding apertures on the lips 34, 36, 38 (FIG. 1) on the bottom cabinet 20. The other aperture 60, 62, 64 and 66 on each flange 56 and 58 is aligned with a corresponding aperture 41, 43, 45 and 47 provided on the caster support plate 44 used to secure the caster assembly 40 thereto.

Figure 5:
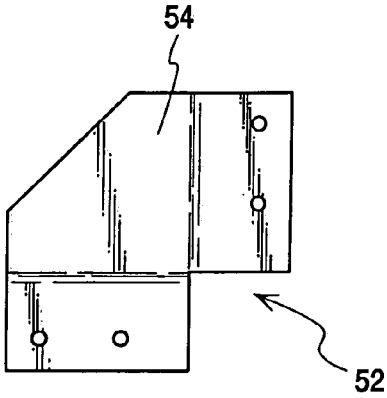
FIG. 5 is a plan view of the flat pattern of the bracket illustrated in FIG. 4, shown with exemplary dimensions and an exemplary configuration.

The mounting bracket 52 may be formed from a piece of flat stock, for example, 0.070 inches (galvanized sheet gage 15) of galvanized steel. Other gages and materials are also suitable. Exemplary dimensions are illustrated in FIGS. 5–7 for a bracket for use with an open bottom file cabinet, for example, the open bottom file cabinet 20 illustrated in FIG. 1.

As shown, the bracket 52 is formed with a gusset plate portion 54 having a truncated corner. Other geometrical configurations for the gusset plate portion 54 are considered to be within the broad scope of the present invention. For example, the gusset plate portion 54 may be provided without the truncated corner in a generally rectangular or square shape. In addition, rather than a truncated corner, the gusset plate portion 54 may be formed with a rounded portion.

As shown in FIGS. 4, 6 and 7, the flanges 56 and 58 are shown in a raised plane relative to the gusset plate portion 54. The principles of the present invention are also suitable to configurations of the bracket 52 in which the flange portions 56 and 58 are in the same plane as the gusset plate portion 54.

Figure 8:
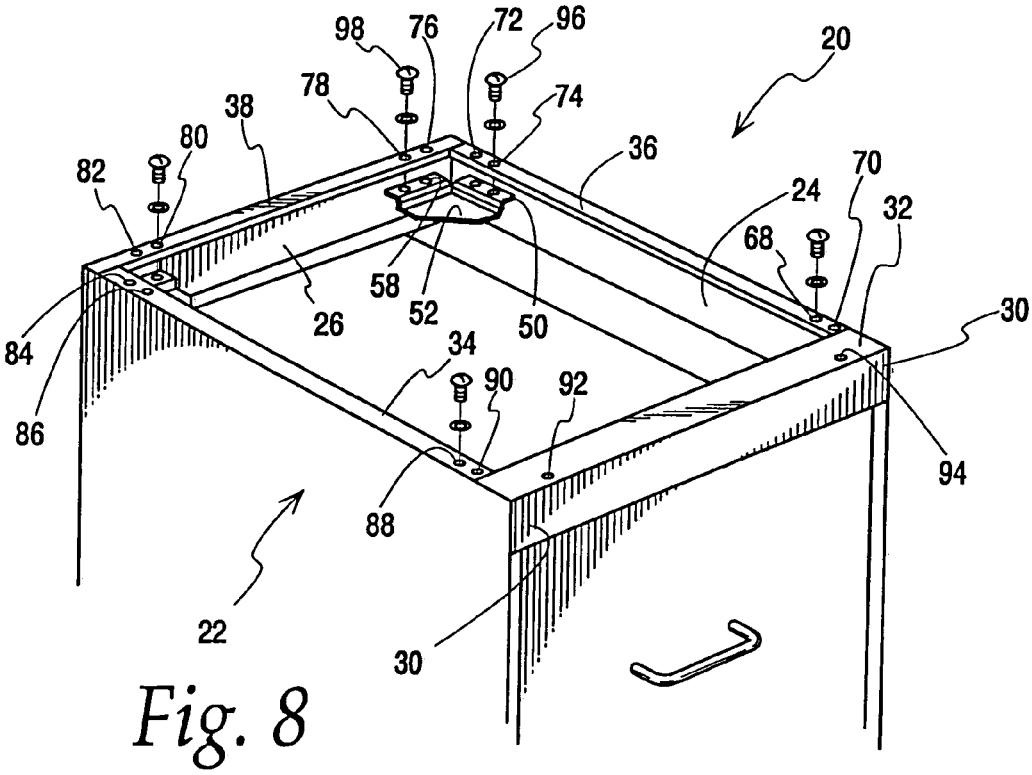
FIG. 8 is a partial perspective view of a cabinet of an open bottom cabinet illustrating the method for securing the bracket in accordance with the present invention to the bottom of the cabinet.

FIGS. 8 and 9 illustrate the installation of the bracket 52 and caster assembly 40 to an open bottom cabinet 20 in accordance with the present invention. As shown, two apertures 68 and 70; 72 and 74; 76 and 78; 80 and 82; 84 and 86; 88 and 90, may be provided adjacent each end of the lips 34 and 36 on the side panels 22 and 24, respectively, as well as the lip 38, on the rear panel 26. One or more apertures 92 and 94 may be provided adjacent the ends of the front lip 32 of the L-shaped channel 30. For the exemplary bracket 52 shown in FIG. 4, the bracket 52 is positioned so that the apertures 60, 62, 64 and 66 are aligned with the apertures 72, 74, 76 and 78 respectively. As show in FIG. 8, the bracket 52 is secured to the underside of the lips 32, 34, 36 and 38. One bracket 52 is installed in each corner of the cabinet 20 and secured thereto by way of a pair of fasteners, generally identified by the reference numerals 96. 98 and 100.

Referring to FIG. 9, after the brackets 52 have been installed in the corners of the cabinet 20, the caster assemblies 40 are secured thereto. In particular, two of the apertures 41, 43, 45 and 47 in the caster support plate 44 are aligned with two of the apertures 68, 70, 72, 74, 76, 78, 84, 86, 88, 90, 92 and 94 formed in the lips 32, 34, 36 and 38. The caster assemblies 40 are secured thereto by way of conventional fasteners, generally identified with the reference numeral 100. With such configuration, the lips 34 and 36 on the side panels 22 and 24, as well as the lips 38 on the rear panel 26 are sandwiched between the support plates 44 of the caster assembly 40 and the flanges 56 and 58 of the brackets 52. Similarly, the angle bracket, comprising L-shaped channel 30, is sandwiched between the support plate 44 on the caster assemblies 40 and the flanges 56 and 58 on the brackets 52. Installation of the legs 51, illustrated in FIG. 10 and the stacking bracket 49 (FIGS. 12 and 13) is accomplished in a similar manner.

Figure 14:
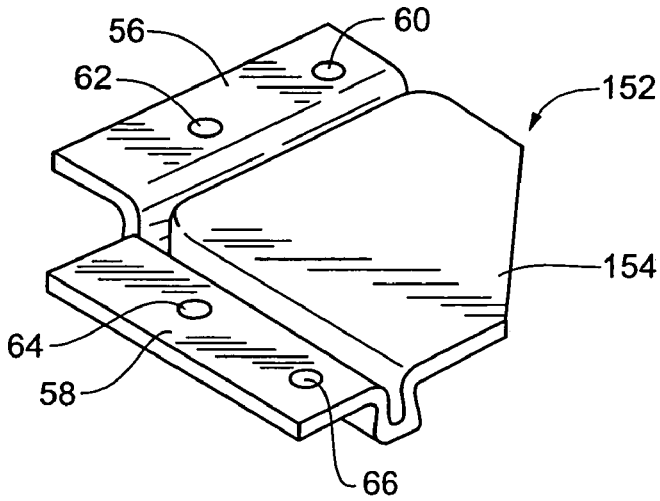
FIG. 14 is a perspective view of an alternative embodiment of a bracket in accordance with the present invention.

As shown in FIG. 14, an alternative embodiment of the bracket is formed as a corner bracket 152 and includes a gusset plate 154 defining at least two sides and a corner and a pair of flanges 56 and 58. The structure of bracket 152 is very similar to that of the bracket 52 illustrated in FIG. 4, and only those elements that differ from the structure of the bracket 52 will be designated with different identification numerals. Those elements that are identical to the elements of bracket 52 will be designated with identical identification numerals.

Each of the flanges 56 and 58 of bracket 152 includes a pair of spaced apart apertures 60 and 62; 64 and 66; and each of the flanges 56 and 58 is adapted to be aligned with corresponding apertures on the lips 34, 36, 38 (FIG. 1) on the bottom cabinet 20. The other aperture 60, 62, 64 and 66 on each flange 56 and 58 is aligned with a corresponding aperture 41, 43, 45 and 47 provided on the caster support plate 44 used to secure the caster assembly 40 thereto. As is shown in the alternative embodiment bracket 152, the gusset plate 154 is in the same plane as that of the two flanges 56, 58, by virtue of the bending process used to fabricate the flanges.

Obviously, many modifications and variations of the present invention are possible in light of the above teachings. Thus, it is to be understood that, within the scope of the appended claims, the invention may be practiced otherwise than as specifically described above.

What is claimed is:

1. A method for adding casters to an open bottom type cabinet, the method comprising the steps of:

(a) providing an open bottom type cabinet formed with support lips defining four corners for supporting the cabinet in an upright position, the support lips provided with a plurality of first apertures;

(b) providing a bracket, configured to be secured in the corners of the cabinet; said bracket provided with a plurality of apertures configured to be aligned with said first apertures and secured thereto; and (c) providing a caster assembly having a caster support plate formed with a plurality of third apertures, said third apertures configured to be aligned with said first and second apertures;

(d) securing said brackets to said corners of said support lips with a plurality of fasteners; and (e) securing said caster assembly to said bracket, so that said support lips are sandwiched therebetween.

2. A bracket for an open bottom type cabinet, the bracket comprising:

a gusset plate defining at least two sides and one corner; and two flange portions, each of said flange portions extending essentially parallel and offset to the plane of the gusset plate and each being formed adjacent each of said at least two sides, and each said flange portion formed with at least one aperture, wherein the at least one aperture is shaped, positioned and oriented to enable attachment of both the bracket and a caster assembly to the open bottom type cabinet.

3. The bracket as recited in claim 2, wherein said two flange portions and said gusset plate are formed from steel.

4. The bracket as recited in claim 2, wherein said gusset plate is formed in a generally square shape.

5. The bracket as recited in claim 4, wherein said gusset plate is formed with said corner truncated.

6. The bracket as recited in claim 2, wherein the flange portions are formed in a different plane than said gusset plate.

7. A bracket for an open bottom type cabinet, the bracket comprising:

a gusset plate defining at least two sides and one corner; and two flange portions, each said flange portions being formed offset and in essentially the same plane as the gusset plate and each being formed adjacent each of said at least two sides, and each said flange portion formed with at least one aperture, wherein the at least one aperture is shaped, positioned and oriented to enable attachment of both the bracket and a caster assembly to the open bottom type cabinet.

8. The bracket as recited in claim 7, wherein said two flange portions and said gusset plate are formed from steel.

9. The bracket as recited in claim 7, wherein said gusset plate is formed in a generally square shape.

10. The bracket as recited in claim 9, wherein said gusset plate is formed with said corner truncated.

* * * * *